US011651746B2

(12) United States Patent
Cheng et al.

(10) Patent No.: US 11,651,746 B2
(45) Date of Patent: May 16, 2023

(54) BACKLIGHT DRIVING DEVICE AND OPERATING METHOD THEREOF

(71) Applicant: Novatek Microelectronics Corp., Hsinchu (TW)

(72) Inventors: Jhih-Siou Cheng, New Taipei (TW); Hung-Ho Huang, Hsinchu (TW); Kang-Fan Yeh, Taoyuan (TW); Po-Hsiang Fang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/855,606

(22) Filed: Jun. 30, 2022

(65) Prior Publication Data

US 2023/0005441 A1 Jan. 5, 2023

Related U.S. Application Data

(60) Provisional application No. 63/217,213, filed on Jun. 30, 2021.

(51) Int. Cl.
*G09G 3/34* (2006.01)
*G09G 3/36* (2006.01)

(52) U.S. Cl.
CPC ..... *G09G 3/3426* (2013.01); *G09G 3/36* (2013.01); *G09G 2310/0297* (2013.01); *G09G 2320/0646* (2013.01); *G09G 2360/16* (2013.01)

(58) Field of Classification Search
None
See application file for complete search history.

(56) References Cited

U.S. PATENT DOCUMENTS

2013/0271436 A1* 10/2013 Shiomi ..... G09G 3/36 345/204
2018/0033379 A1* 2/2018 Li ..... G09G 3/3406

* cited by examiner

*Primary Examiner* — Chad M Dicke
(74) *Attorney, Agent, or Firm* — JCIPRNET

(57) ABSTRACT

A backlight driving device and an operating method thereof are provided to drive multiple backlight zones of a backlight panel. The backlight driving device includes an interface circuit and a driving circuit. The interface circuit receives main backlight data corresponding to a first backlight zone from a former stage device. The driving circuit drives the first backlight zone according to a main current level in a display refresh period of a backlight frame period, does not drive the first backlight zone in a demotion blur period which is prior to the display refresh period, and drives the first backlight zone according to a compensation current level in a vertical blanking period which succeeds the display refresh period. The driving circuit determines the main current level according to the main backlight data, and the compensation current level is lower than the main current level.

13 Claims, 11 Drawing Sheets

BACKLIGHT DRIVING DEVICE AND OPERATING METHOD THEREOF

CROSS-REFERENCE TO RELATED APPLICATION

This application claims the priority benefit of U.S. provisional application Ser. No. 63/217,213, filed on Jun. 30, 2021. The entirety of the above-mentioned patent application is hereby incorporated by reference herein and made a part of this specification.

BACKGROUND

Technical Field

The disclosure relates to a display device, and more particularly to a backlight driving device and an operating method thereof.

Description of Related Art

The variable refresh rate (VRR) refers to adjusting the frame rate of a display device to match the dynamic change of the refresh rate of an image source device. In the VRR mode, the frame rate of a display panel usually changes at any time and is affected by the image scene. The VRR mode may eliminate the phenomenon of intermittent delay and screen tearing, so as to generate smoother images. In addition, the response speed of liquid crystal of a liquid-crystal display (LCD) panel is too slow, which causes motion blur. Demotion blur is a technology developed for the motion blur of the display panel. Currently, the conventional backlight panel driving method cannot satisfy VRR and demotion blur at the same time. How to perform dimming on multiple backlight zones of the backlight panel to adapt to the VRR mode of the display panel and to have the demotion blur function is one of the many technical issues in the field of backlight technology.

SUMMARY

The disclosure provides a backlight driving device and an operating method thereof to drive multiple backlight zones of a backlight panel to provide backlight to different display regions of a display panel.

In an embodiment of the disclosure, the backlight driving device includes an interface circuit and a driving circuit. The interface circuit is adapted for receiving first main backlight data corresponding to a first backlight zone among the backlight zones from a former stage device. The driving circuit is adapted for driving the first backlight zone among the backlight zones according to a first main current level in a display refresh period of a first backlight frame period with respect to the first backlight zone, not driving the first backlight zone in a demotion blur period of the first backlight frame period which is prior to the display refresh period, and driving the first backlight zone according to a first compensation current level in a vertical blanking period of the first backlight frame period which succeeds the display refresh period of the first backlight frame period. The driving circuit determines the first main current level according to the first main backlight data, and the first compensation current level is lower than the first main current level.

In an embodiment of the disclosure, the operating method includes the following steps. First main backlight data corresponding to a first backlight zone among the backlight zones is received from a former stage device by an interface circuit of a backlight driving device. The first backlight zone among the backlight zones is driven by a driving circuit of the backlight driving device according to a first main current level in a display refresh period of a first backlight frame period with respect to the first backlight zone. The first backlight zone is not driven by the driving circuit in a demotion blur period of the first backlight frame period which is prior to the display refresh period. The first backlight zone is driven by the driving circuit according to a first compensation current level in a vertical blanking period of the first backlight frame period which succeeds the display refresh period of the first backlight frame period. The driving circuit determines the first main current level according to the first main backlight data, and the first compensation current level is lower than the first main current level.

Based on the above, the backlight panel according to the embodiments of the disclosure has multiple backlight zones, and different backlight zones correspond to different display regions of the display panel. For any backlight zone, the backlight frame period thereof corresponds to the display frame period of the display panel. Each backlight frame period includes the demotion blur period, the display refresh period, and the vertical blanking period. The driving circuit does not drive the backlight zone in the demotion blur period, that is, the backlight zone does not provide backlight to the corresponding display region of the display panel in the demotion blur period, so as to prevent a viewer from perceiving the motion blur of the display panel. In the display refresh period which succeeds the demotion blur period, the driving circuit drives the backlight zone with the main current level corresponding to the main backlight data, so as to provide brighter backlight to the corresponding display region of the display panel. In the vertical blanking period which succeeds the display refresh period, the driving circuit drives the backlight zone with the compensation current level lower than the main current level, so as to provide darker backlight to the corresponding display region of the display panel. Therefore, the dimming of the backlight zone may be adapted to the variable refresh rate (VRR) mode of the display panel.

In order for the features and advantages of the disclosure to be more comprehensible, the following specific embodiments are described in detail in conjunction with the drawings.

DETAILED DESCRIPTION OF DISCLOSED EMBODIMENTS

Figure 1:
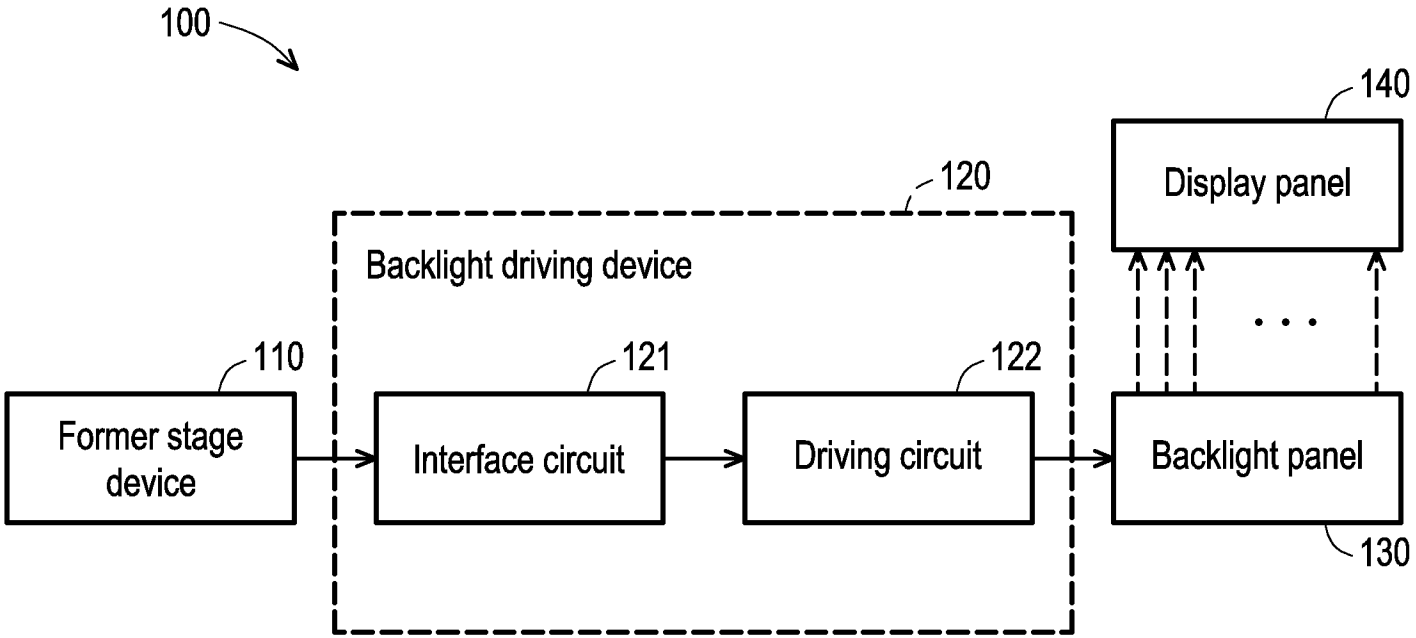
FIG. 1 is a schematic diagram of a circuit block of a display device according to an embodiment of the disclosure.

The term "coupling (or connection)" used in the entire specification (including the claims) of the disclosure may refer to any direct or indirect connection means. For example, if a first device is described as being coupled (or connected) to a second device, it should be interpreted that the first device may be directly connected to the second device or the first device may be indirectly connected to the second device through another device or certain connection means. Terms such as "first" and "second" mentioned in the entire specification (including the claims) of the disclosure are used to name the elements or to distinguish between different embodiments or ranges, but not to limit the upper limit or the lower limit of the number of elements or to limit the sequence of the elements. In addition, wherever possible, elements/components/steps using the same reference numerals in the drawings and embodiments represent the same or similar parts. Related descriptions of the elements/components/steps using the same reference numerals or using the same terminologies in different embodiments may be cross-referenced.

FIG. 1 is a schematic diagram of a circuit block of a display device 100 according to an embodiment of the disclosure. The display device 100 shown in FIG. 1 includes a former stage device 110, a backlight driving device 120, a backlight panel 130, and a display panel 140. According to the actual design, in some embodiments, the former stage device 110 may include an image scaler IC or a timing controller for controlling the display panel 140. The backlight driving device 120 may drive multiple backlight zones of the backlight panel 130 to provide backlight to different display regions of the display panel 140. For example, the backlight driving device 120 may control the backlight panel 130 to perform global dimming (to perform the same dimming on different backlight zones) or local dimming (to perform different dimming on different backlight zones).

Any backlight zone of the backlight panel 130 may correspond to a corresponding display region of the display panel 140. For example, it is assumed here that one backlight zone of the backlight panel 130 corresponds to pixels of N scan lines of the display panel 140. A first backlight zone of the backlight panel 130 corresponds to pixels of the 1-st to N-th scan lines of the display panel 140, a second backlight zone of the backlight panel 130 corresponds to pixels of the (N+1)-th to 2N-th scan lines of the display panel 140, a third backlight zone of the backlight panel 130 corresponds to pixels of the (2N+1)-th to 3N-th scan lines of the display panel 140, and a fourth backlight zone of the backlight panel 130 corresponds to pixels of the (3N+1)-th to 4N-th scan lines of the display panel 140.

A certain backlight zone (herein referred to as a target backlight zone) of the backlight panel 130 may provide backlight to a certain corresponding display region (herein referred to as a target display region) of the display panel 140. The former stage device 110 may calculate main backlight data of the target backlight zone according to multiple pixel data of the target display region, and provide the main backlight data to the backlight driving device 120. The backlight driving device 120 may drive the target backlight zone of the backlight panel 130 based on the main backlight data, so as to provide backlight to the target display region of the display panel 140.

Figure 2:
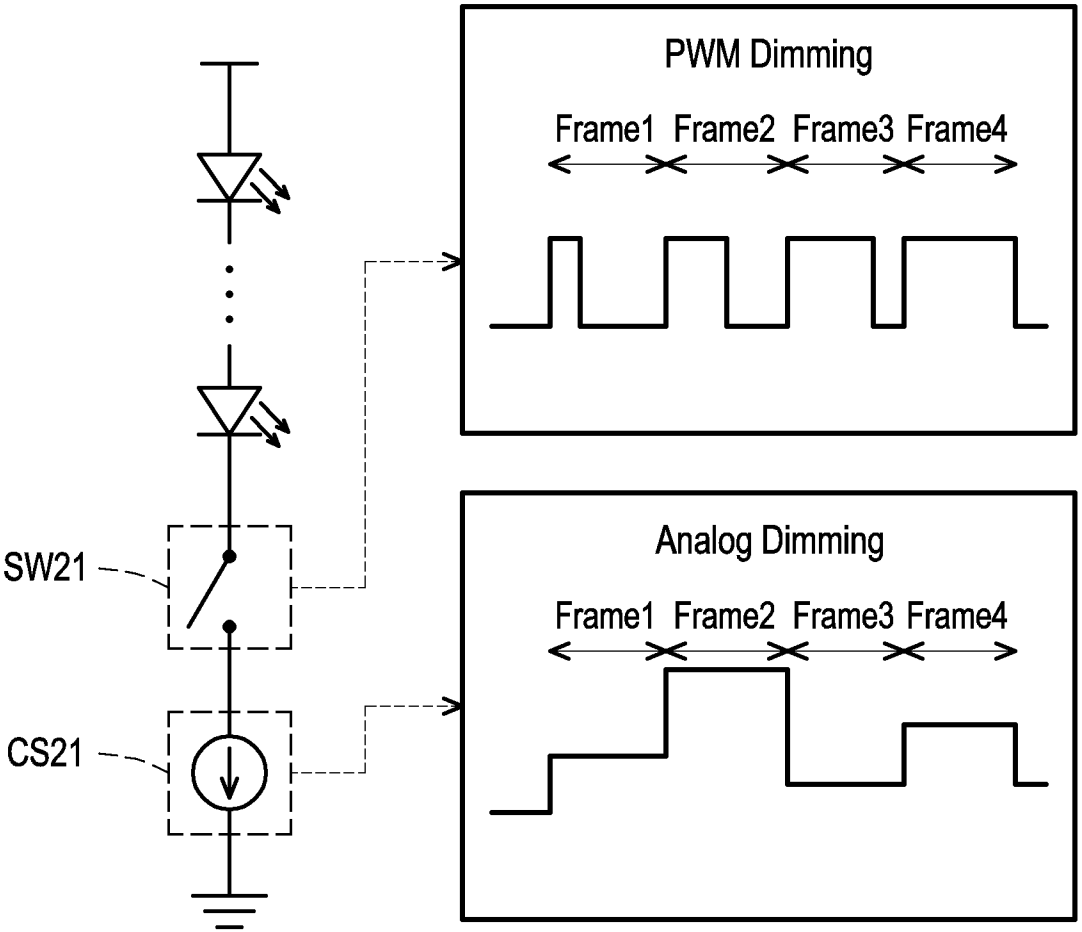
FIG. 2 is a schematic diagram of an equivalent circuit of a backlight zone of a backlight panel and a schematic diagram of different dimming manners.

FIG. 2 is a schematic diagram of an equivalent circuit of a backlight zone of the backlight panel 130 and a schematic diagram of different dimming manners. In the embodiment shown in FIG. 2, the backlight panel 130 may be a light-emitting diode (LED) backlight panel. The left part of FIG. 2 shows the equivalent circuit of a certain backlight zone of the backlight panel 130. In the embodiment shown in FIG. 2, the dimming manners of the backlight zone include pulse-width-modulated (PWM) dimming and analog dimming. The upper right part of FIG. 2 shows a schematic diagram of a current waveform of PWM dimming, and the lower right part of FIG. 2 shows a schematic diagram of a current waveform of analog dimming, where Frame1, Frame2, Frame3, and Frame4 represent different backlight frame periods.

The backlight driving device 120 may control a switch SW21 and a current source CS21 of the backlight zone shown in FIG. 2. By changing the duty ratio of the conduction period of the switch SW21 of the backlight zone, the average current (average brightness) of the LED may be adjusted. By changing the current magnitude of the current source CS21 of the backlight zone, the driving current (brightness) of the LED may be adjusted. On the premise of supporting the variable refresh rate (VRR) technology, the analog dimming manner shown in the lower right part of FIG. 2 may be used for the control of the backlight panel 130. Compared with the analog dimming manner, the PWM dimming manner shown in the upper right part of FIG. 2 may cause a screen to flicker when the display panel 140 performs a VRR operation.

Figure 3:
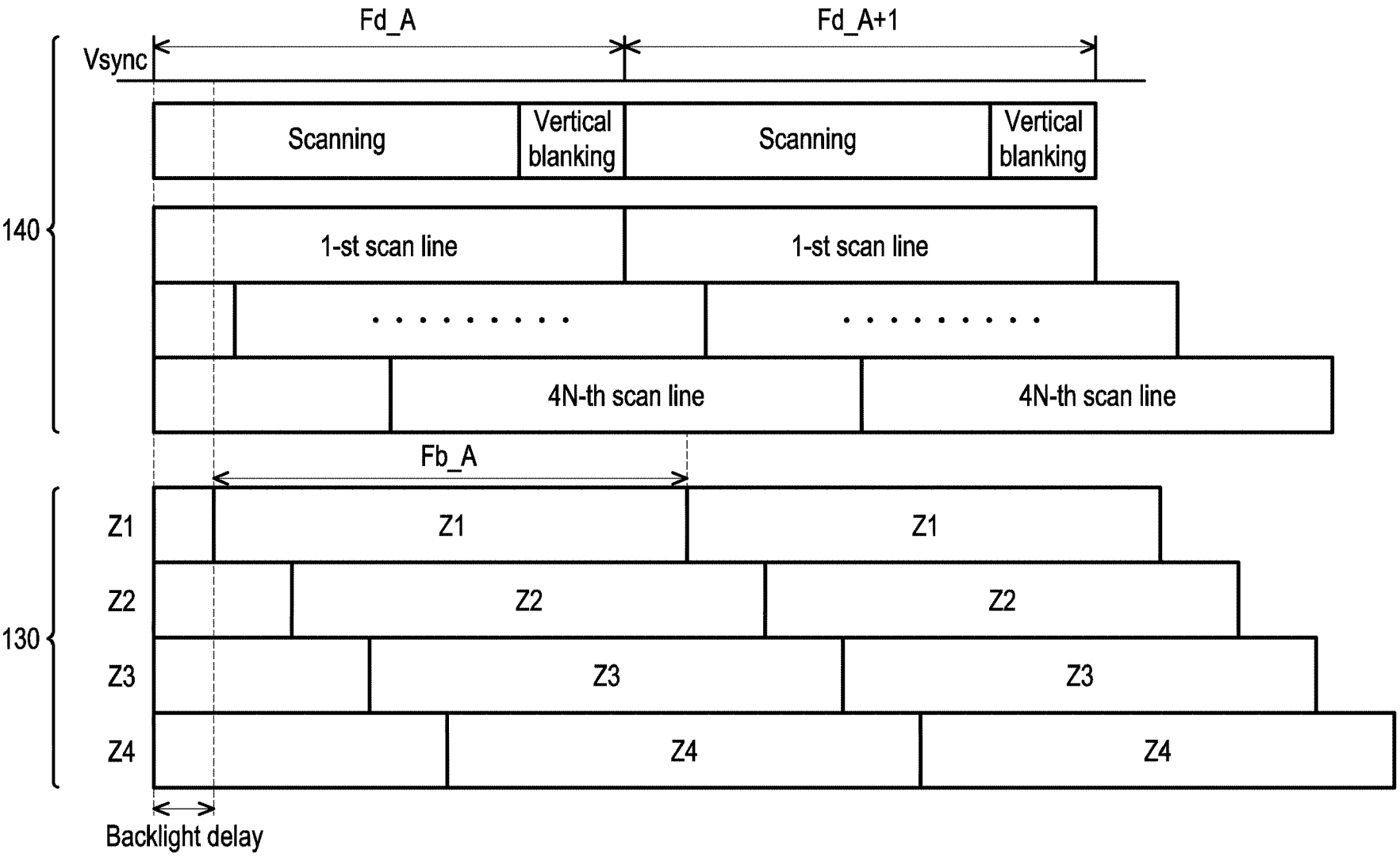
FIG. 3 is a timing schematic diagram of a driving manner (line-by-line scanning) of a display panel and a local dimming manner (zoned dimming) of a backlight panel according to an embodiment.

A backlight driving manner of zoned scanning will be described below with reference to FIG. 3 and FIG. 4. FIG. 3 is a timing diagram of a driving manner (line-by-line scanning) of the display panel 140 and a local dimming manner (zoned dimming) of the backlight panel 130 according to an embodiment. The upper part of FIG. 3 is a schematic diagram of a driving timing of the display panel 140, and the lower part of FIG. 3 is a schematic diagram of a driving timing of the backlight panel 130, where Fd_A and Fd_A+1 represent different display frame periods. The display frame periods Fd_A and Fd_A+1 may be defined by a vertical synchronization signal Vsync. The display frame period Fd_A includes a scanning period (valid data period) and a vertical blanking period, and the display frame period Fd_A+1 includes another scanning period (valid data period) and another vertical blanking period.

In the embodiment shown in FIG. 3, assuming that the backlight panel 130 includes 4 backlight zones Z1, Z2, Z3, and Z4, any backlight zone of the backlight panel 130 is pixels corresponding to N scanning lines of the display panel 140. That is, the backlight zone Z1 of the backlight panel 130 corresponds to pixels of the 1-st to N-th scan lines of the display panel 140, the backlight zone Z2 of the backlight panel 130 corresponds to pixels of the (N+1)-th to 2N-th scan lines of the display panel 140, the backlight zone Z3 of the backlight panel 130 corresponds to pixels of the (2N+1)-th to 3N-th scan lines of the display panel 140, and the backlight zone Z4 of the backlight panel 130 corresponds to pixels of the (3N+1)-th to 4N-th scan lines of the display panel 140.

The driving timing of the backlight panel 130 is shown in the lower part of FIG. 3. For any backlight zone of the backlight panel 130, the backlight frame period thereof corresponds to the display frame period of the display panel 140. Taking the backlight zone Z1 as an example, a backlight frame period Fb_A of the backlight zone Z1 corresponds to the display frame period Fd_A of the display panel 140. The backlight zones Z1 to Z4 of the backlight panel 130 are sequentially delay-refreshed along the vertical direction, so as to be aligned (synchronized) with the scan driving timing of the display panel 140. The driving manner of the backlight panel 130 shown in FIG. 3 may solve the issue of flicker and blur caused by "the brightness refresh of the backlight panel 130 being not aligned with the scan timing of the display panel 140".

Figure 4:
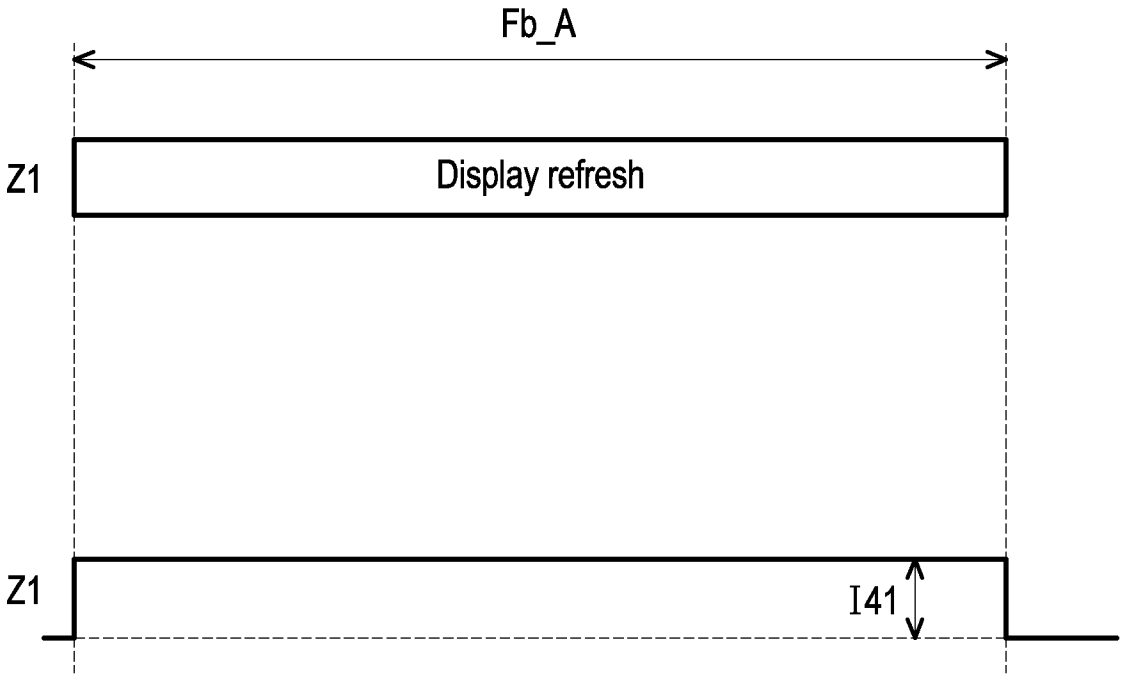
FIG. 4 is a schematic diagram of a waveform of a driving current of a backlight zone according to an embodiment of the disclosure.

FIG. 4 is a schematic diagram of a waveform of a driving current of a backlight zone Z1 according to an embodiment of the disclosure. The upper part of FIG. 4 shows the backlight frame period Fb_A of the backlight zone Z1 and the display refresh period in the backlight frame period Fb_A. The lower part of FIG. 4 shows a main current level I41 used by the backlight driving device 120 to drive the backlight zone Z1 in the display refresh period. Please refer to FIG. 3 and FIG. 4. In the case where demotion blur is not performed, based on a dimming algorithm, the backlight driving device 120 may determine the main current level I41 of the backlight zone Z1 according to the main backlight data received from the former stage device. In the display refresh period, the backlight driving device 120 may drive the corresponding backlight zone Z1 according to the main current level I41.

Figure 5:
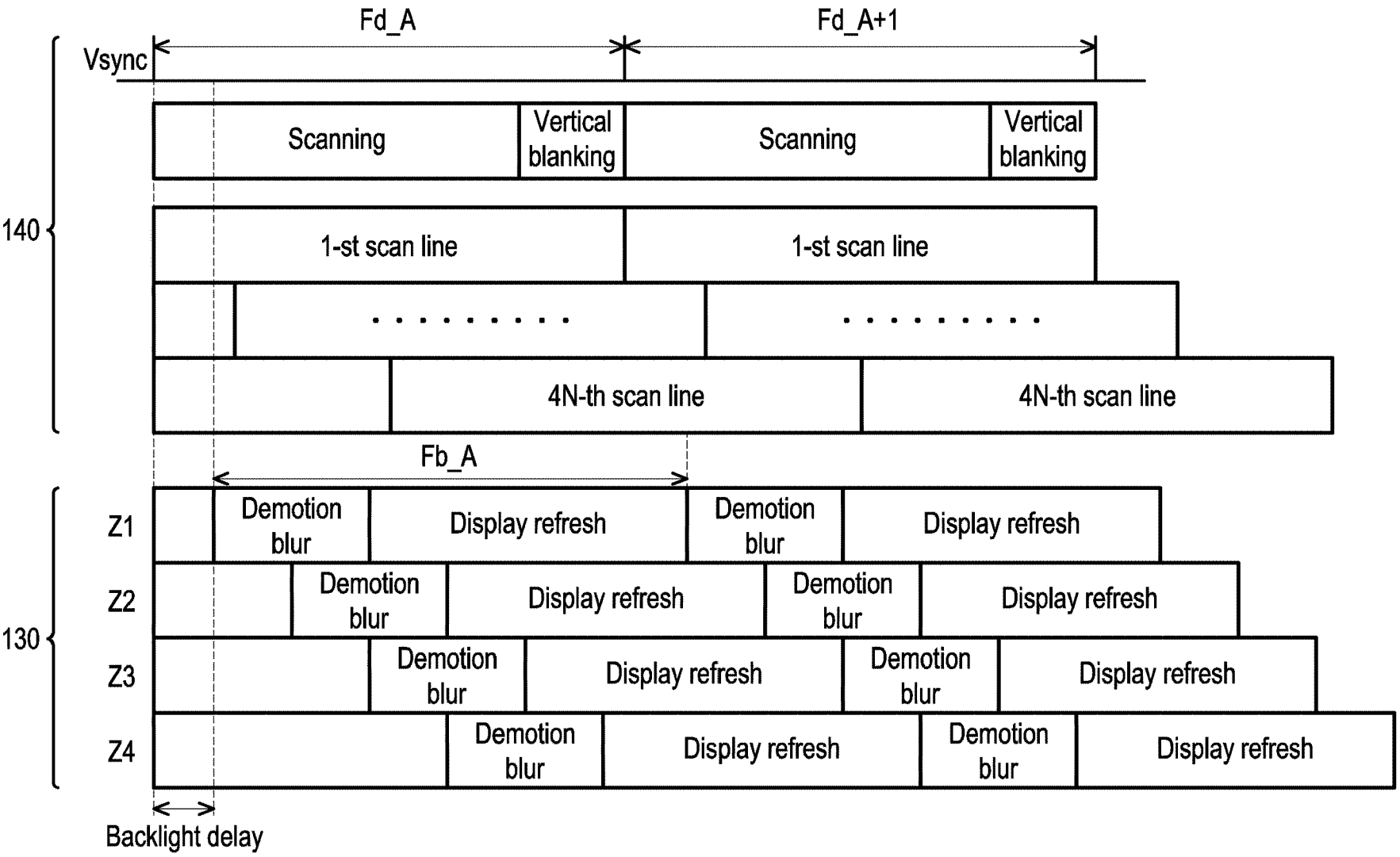
FIG. 5 is a timing diagram of a driving manner (line-by-line scanning) of a display panel and a local dimming manner (zoned dimming) of a backlight panel according to another embodiment.
Figure 6:
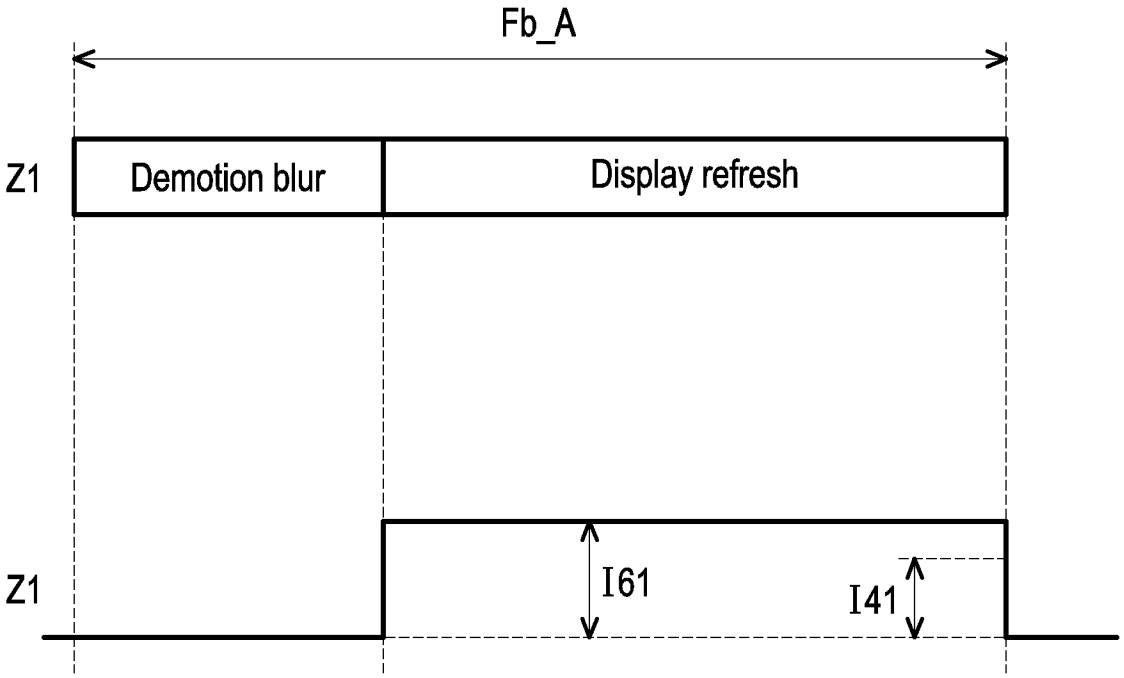
FIG. 6 is a schematic diagram of a waveform of a driving current of a backlight zone according to another embodiment of the disclosure.

A backlight driving manner of demotion blur will be described below with reference to FIG. 5 and FIG. 6. FIG. 5 and FIG. 6 may be analogized with reference to the relevant descriptions of FIG. 3 and FIG. 4. FIG. 5 is a timing diagram of a driving manner (line-by-line scanning) of the display panel 140 and a local dimming manner (zoned dimming) of the backlight panel 130 according to another embodiment. In the embodiment shown in FIG. 5, due to the slow inversion speed of pixel liquid crystal, the inversion process of the pixel liquid crystal (erroneous display) may be noticed by a user, which is the so-called motion blur. In order to remove motion blur, the driving device 120 may reduce the brightness of the corresponding backlight zone (or even turn off the corresponding backlight zone) in the inversion process of the pixel liquid crystal (that is, in the demotion blur period), as shown in FIG. 5. For example, the backlight driving device 120 does not drive the backlight zone of the backlight panel 130 in the demotion blur period. After the liquid crystal is inverted (that is, in the display refresh period), the driving device 120 may adjust the corresponding backlight zone back to normal brightness, as shown in FIG. 5. For example, the backlight driving device 120 drives the corresponding backlight zone according to the main current level in the display refresh period. Therefore, the demotion blur technology of backlight shown in FIG. 5 may reduce the erroneous display in the inversion process of the liquid crystal.

FIG. 6 is a schematic diagram of a waveform of a driving current of the backlight zone Z1 according to another embodiment of the disclosure. The upper part of FIG. 6 shows the backlight frame period Fb_A of the backlight zone Z1, and the demotion blur period and the display refresh period in the backlight frame period Fb_A. The lower part of FIG. 6 shows a main current level I61 used by the backlight driving device 120 to drive the backlight zone Z1 in the display refresh period. For the convenience of comparison, the main current level I41 shown in FIG. 4 is also shown in the lower part of FIG. 6.

Please refer to FIG. 5 and FIG. 6. In the case where demotion blur is performed, the backlight driving device 120 does not drive the backlight zone Z1 of the backlight panel 130 in the demotion blur period. Based on the dimming algorithm, the backlight driving device 120 may determine the main current level I61 of the backlight zone Z1 according to the main backlight data received from the former stage device. In the display refresh period, the backlight driving device 120 may drive the corresponding backlight zone Z1 according to the main current level I61.

In order to remove motion blur, the driving device 120 may reduce the driving current of the backlight zone Z1 (reduce the brightness of the backlight zone row) in the inversion process of the pixel liquid crystal (that is, in the demotion blur period), as shown in the lower part of FIG. 6. After the liquid crystal is inverted (that is, in the display refresh period), the driving device 120 may increase the driving current of the backlight zone Z1 to the main current level I61. Since the backlight zone Z1 does not emit light in the demotion blur period in the backlight frame period Fb_A (for example, ⅓ of the backlight frame period Fb_A), the main current level I61 of the backlight zone Z1 in the display refresh period of the backlight frame period Fb_A (for example, ⅔ of the backlight frame period Fb_A) must be greater than the main current level I41 shown in FIG. 4, so that the average brightness of the backlight zone Z1 in the backlight frame period Fb_A may be close to (or the same as) the average brightness of the backlight frame period Fb_A shown in FIG. 4.

In order to increase the brightness in the remaining time after deducting the demotion blur period, the driving current level (main current level I61) of the backlight zone Z1 is increased to be greater than the main current level I41 shown in FIG. 4. For example, assuming that the main current level I41 (the original driving current level calculated based on the dimming algorithm) shown in FIG. 4 is I, and the demotion blur period and the display refresh period are respectively ⅓ of the backlight frame period Fb_A and ⅔ of the backlight frame period Fb_A, the driving current level (main current level I61) of the backlight zone Z1 may be increased to I*3/2 after the demotion blur period ends.

Figure 7:
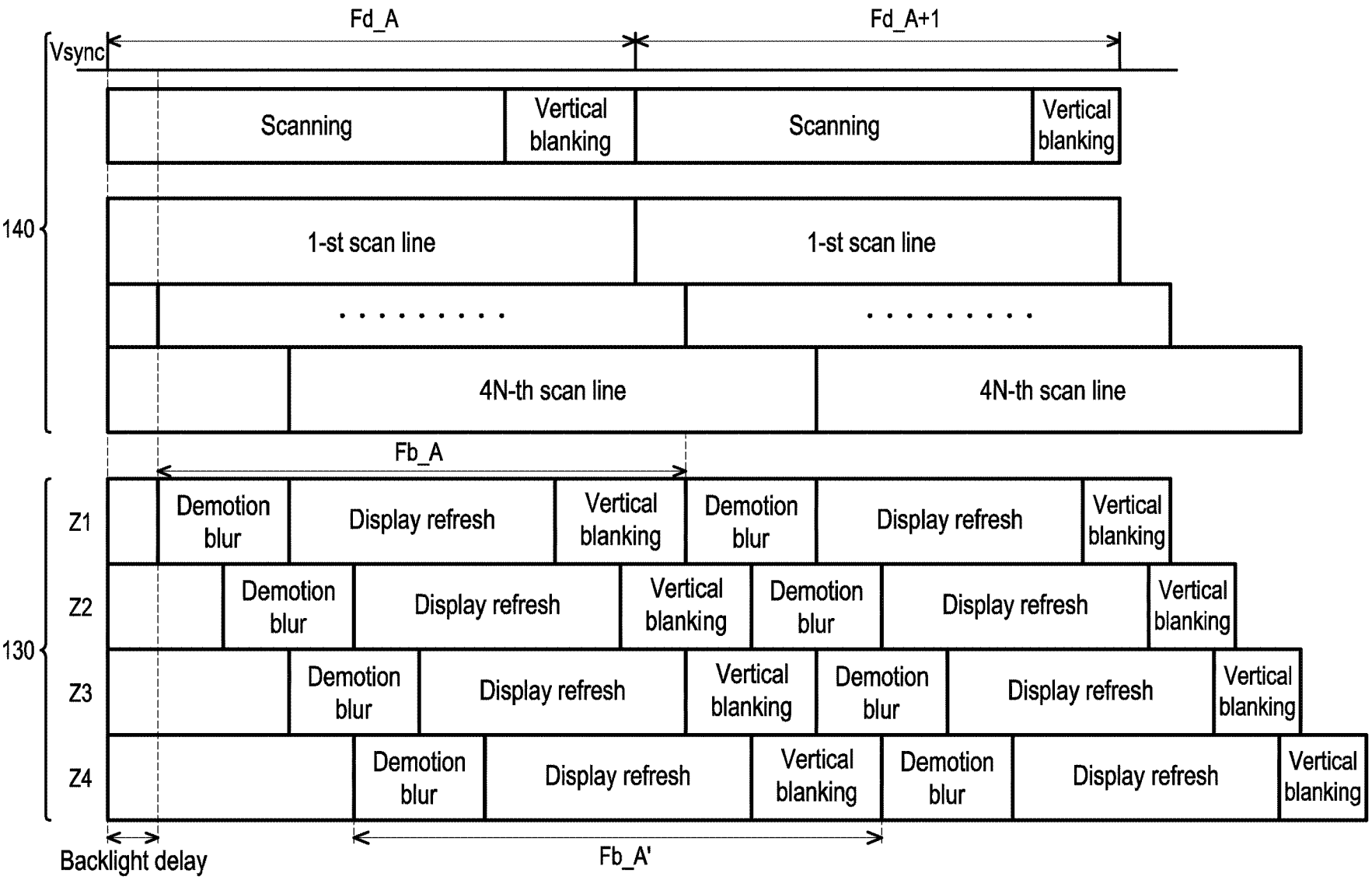
FIG. 7 is a timing diagram of a driving manner (line-by-line scanning) of a display panel and a local dimming manner (zoned dimming) of a backlight panel according to yet another embodiment.
Figure 8:
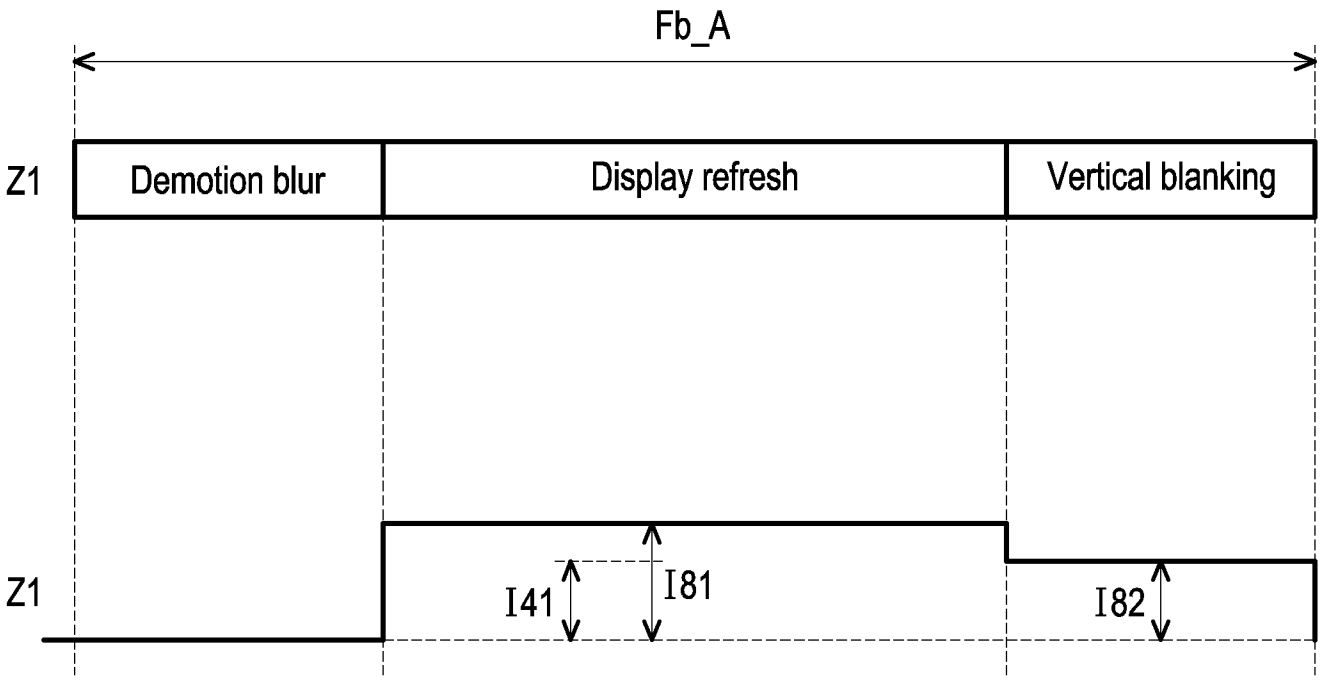
FIG. 8 is a schematic diagram of a waveform of a driving current of a backlight zone according to yet another embodiment of the disclosure.

A backlight driving manner that combines the demotion blur function (as shown in the example shown in FIG. 5 and FIG. 6) and the mode supporting variable refresh rate (VRR) will be described below with reference to FIG. 7 and FIG. 8. FIG. 7 and FIG. 8 may be analogized with reference to the relevant descriptions of FIG. 5 and FIG. 6. FIG. 7 is a timing diagram of a driving manner (line-by-line scanning) of the display panel 140 and a local dimming manner (zoned dimming) of the backlight panel 130 according to yet another embodiment. In the embodiment shown in FIG. 7, based on the VRR technology, the length of each display frame period may be dynamically adjusted, that is, the frame rate may be dynamically changed. When the frame rate changes, the length of the vertical blanking (V-blanking) period of each display frame period changes at any time. Taking the display frame periods Fd_A and Fd_A+1 shown in FIG. 7 as an example, the vertical blanking period of the display frame period Fd_A is greater than the vertical blanking period of the display frame period Fd_A+1.

Based on the demotion blur technology, the demotion blur period (the backlight zone not emitting light) occupies a part of each backlight frame period. In order to compensate for the period without light emission, the brightness of the backlight zone is increased in the display refresh period of the backlight frame period. In the VRR mode, however, the length of each vertical blanking period changes over time. If the brightness of the backlight zone in the vertical blanking period is the same as the increased brightness in the display refresh period, it is conceivable that the average brightness of different backlight frame periods cannot be kept consistent due to different lengths of the vertical blanking periods. The backlight driving device 120 may reduce the brightness of each backlight zone of the backlight panel 130 in the vertical blanking period, so that the average brightness of two adjacent backlight frame periods can be kept as consistent as possible.

FIG. 8 is a schematic diagram of a waveform of a driving current of the backlight zone Z1 according to yet another embodiment of the disclosure. The upper part of FIG. 8 shows the backlight frame period Fb_A of the backlight zone Z1, and the demotion blur period, the display refresh period, and the vertical blanking period in the backlight frame period Fb_A. The lower part of FIG. 8 shows a schematic diagram of a waveform of the driving current of the backlight zone Z1 in the backlight frame period Fb_A in the case where demotion blur is performed. The backlight driving device 120 drives the backlight zone Z1 according to a main current level I81 in the display refresh period, and drives the backlight zone Z1 according to a compensation current level I82 in the vertical blanking period.

In order to compensate for the demotion blur period without light emission, the brightness of the backlight zone Z1 is increased in the display refresh period of the backlight frame period Fb_A. Based on the dimming algorithm, the backlight driving device 120 may determine the main current level I81 of the backlight zone Z1 according to the main backlight data received from the former stage device. In the display refresh period, the backlight driving device 120 may drive the corresponding backlight zone Z1 according to the main current level I81. For the convenience of comparison, the main current level I41 shown in FIG. 4 is also shown in the lower part of FIG. 8. In the VRR mode, however, the length of each vertical blanking period changes over time. If the brightness of the backlight zone Z1 in the vertical blanking period is the same as the increased brightness in the display refresh period, it is conceivable that the average brightness of different backlight frame periods cannot be kept consistent due to different lengths of the vertical blanking periods. The backlight driving device 120 may reduce the brightness of the backlight zone Z1 of the backlight panel 130 in the vertical blanking period, so that the average brightness of two adjacent backlight frame periods can be kept as consistent as possible.

Figure 9:
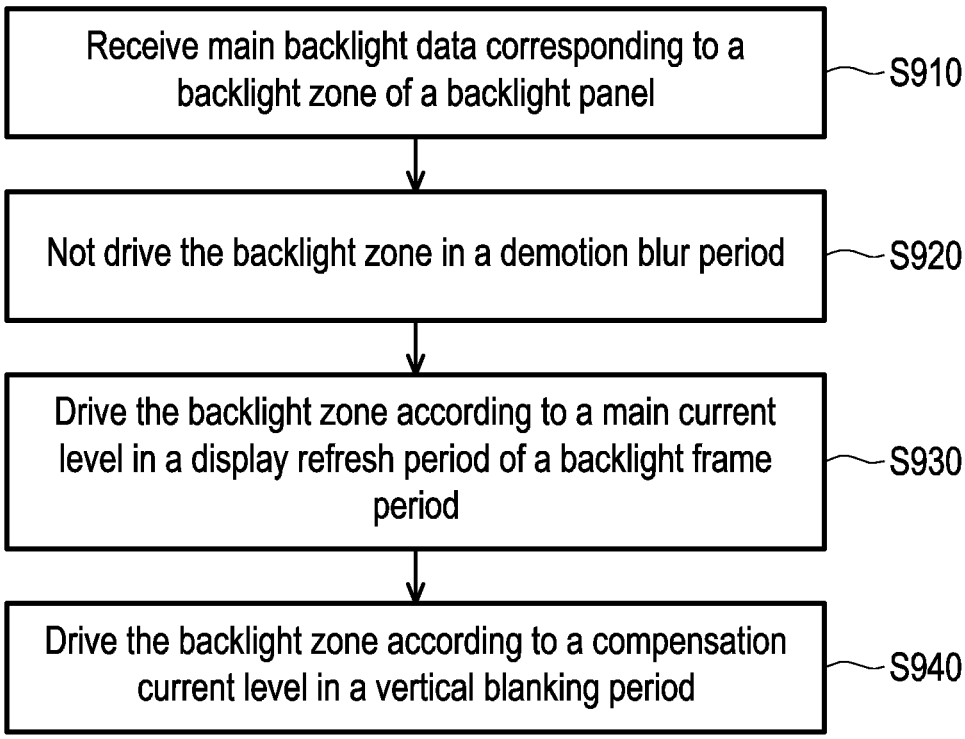
FIG. 9 is a schematic flowchart of an operating method of a backlight driving device according to an embodiment of the disclosure.

FIG. 9 is a schematic flowchart of an operating method of a backlight driving device according to an embodiment of the disclosure. Please refer to FIG. 1 and FIG. 9. The backlight driving device 120 includes an interface circuit 121 and a driving circuit 122. In Step S910, the interface circuit 121 may receive multiple main backlight data corresponding to multiple backlight zones (for example, the backlight zones Z1 to Z4 shown in FIG. 7) of the backlight panel 130 from the former stage device 110. For the convenience of illustration, the backlight zone Z1 is used as an illustrative example below. Other backlight zones of the backlight panel 130 may be analogized with reference to the relevant description of the backlight zone Z1.

Please refer to FIG. 1, FIG. 8, and FIG. 9. In Step S920, the driving circuit 122 may not drive the backlight zone Z1 of the backlight panel 130 in the demotion blur period which is prior to the display refresh period. The driving circuit 122 may determine the main current level 181 according to the main backlight data provided by the interface circuit 121. In Step S930, the driving circuit 122 may drive the backlight zone Z1 of the backlight panel 130 according to the main current level I81 in the display refresh period of the backlight frame period Fb_A with respect to the backlight zone Z1. For example, assuming that the main current level I41 shown in FIG. 4 (the original driving current level calculated based on the dimming algorithm) is I, the demotion blur period shown in FIG. 8 is ⅓ of the valid data period (the scanning period in one display frame period of the display panel 140), and the display refresh period shown in FIG. 8 is ⅔ of the valid data period. The driving circuit 122 may adjust the driving current of the backlight zone Z1 to 0 in the demotion blur period, and increase the driving current of the backlight zone Z1 to I*3/2 (main current level I81) in the display refresh period, so as to maintain the average brightness in the valid data period at the target brightness.

However, different frame periods have vertical blanking periods with different lengths. In the case where the driving current is still maintained at I*3/2 (main current level I81) in the vertical blanking period after the valid data period ends, it is conceivable that the average brightness of such a backlight is erroneous. In Step S940, the driving circuit 122 may drive the backlight zone Z1 of the backlight panel 130 according to the compensation current level I82 in the vertical blanking period which succeeds the display refresh period. The compensation current level I82 is lower than the main current level I81. For example (but not limited to), the compensation current level I82 may be the same as the main current level I41 (the original driving current level calculated based on the dimming algorithm) shown in FIG. 4.

According to the relevant description of the backlight zone Z1, the driving circuit 122 may perform similar operations on other backlight zones of the backlight panel 130 by analogy, as shown in FIG. 7. The driving circuit 122 may not drive the backlight zone Z4 in the demotion blur period of a backlight frame period Fb_A' which is prior to the display refresh period of the backlight frame period Fb_A'. The driving circuit determines the main current level of the backlight zone Z4 according to the main backlight data corresponding to the backlight zone Z4. The driving circuit 122 may drive the backlight zone Z4 according to the main current level in the display refresh period of the backlight frame period Fb_A' with respect to the backlight zone Z4. The driving circuit 122 may drive the backlight zone Z4 according to the compensation current level of the backlight zone Z4 in the vertical blanking period of the backlight frame period Fb_A' which succeeds the display refresh period of the backlight frame period Fb_A'. The compensation current level of the backlight zone Z4 is lower than the main current level of the backlight zone Z4.

The backlight zone Z1 of the backlight panel 130 may be used as a backlight source of a first display region of the display panel 140. After the first display region of the display panel 140 refreshes display data, a second display region of the display panel 140 refreshes display data. Therefore, after the backlight frame period of the backlight zone Z1 starts, the backlight frame period of the backlight zone Z2 starts. The backlight zone Z2 of the backlight panel 130 may be used as a backlight source of the second display region of the display panel 140. After the second display region of the display panel 140 refreshes the display data, a third display region of the display panel 140 refreshes display data. Therefore, after the backlight frame period of the backlight zone Z2 starts, the backlight frame period of the backlight zone Z3 starts. The backlight zone Z3 of the backlight panel 130 may be used as a backlight source of the third display region of the display panel 140. After the third display region of the display panel 140 refreshes the display data, a fourth display region of the display panel 140 refreshes display data. Therefore, after the backlight frame period of the backlight zone Z3 starts, the backlight frame period of the backlight zone Z4 starts. The backlight zone Z4 of the backlight panel 130 may be used as a backlight source of the fourth display region of the display panel 140.

The embodiment does not limit the determining manner of the compensation current level. For example, in some embodiments, the driving circuit 122 may obtain backlight compensation data according to a certain ratio and the main backlight data provided by the former stage device 110, and then determine the compensation current level I82 according to the backlight compensation data. The determination of the ratio is based on the length of the display refresh period of the backlight frame period Fb_A and the length of the demotion blur period of the backlight frame period Fb_A.

Figure 10:
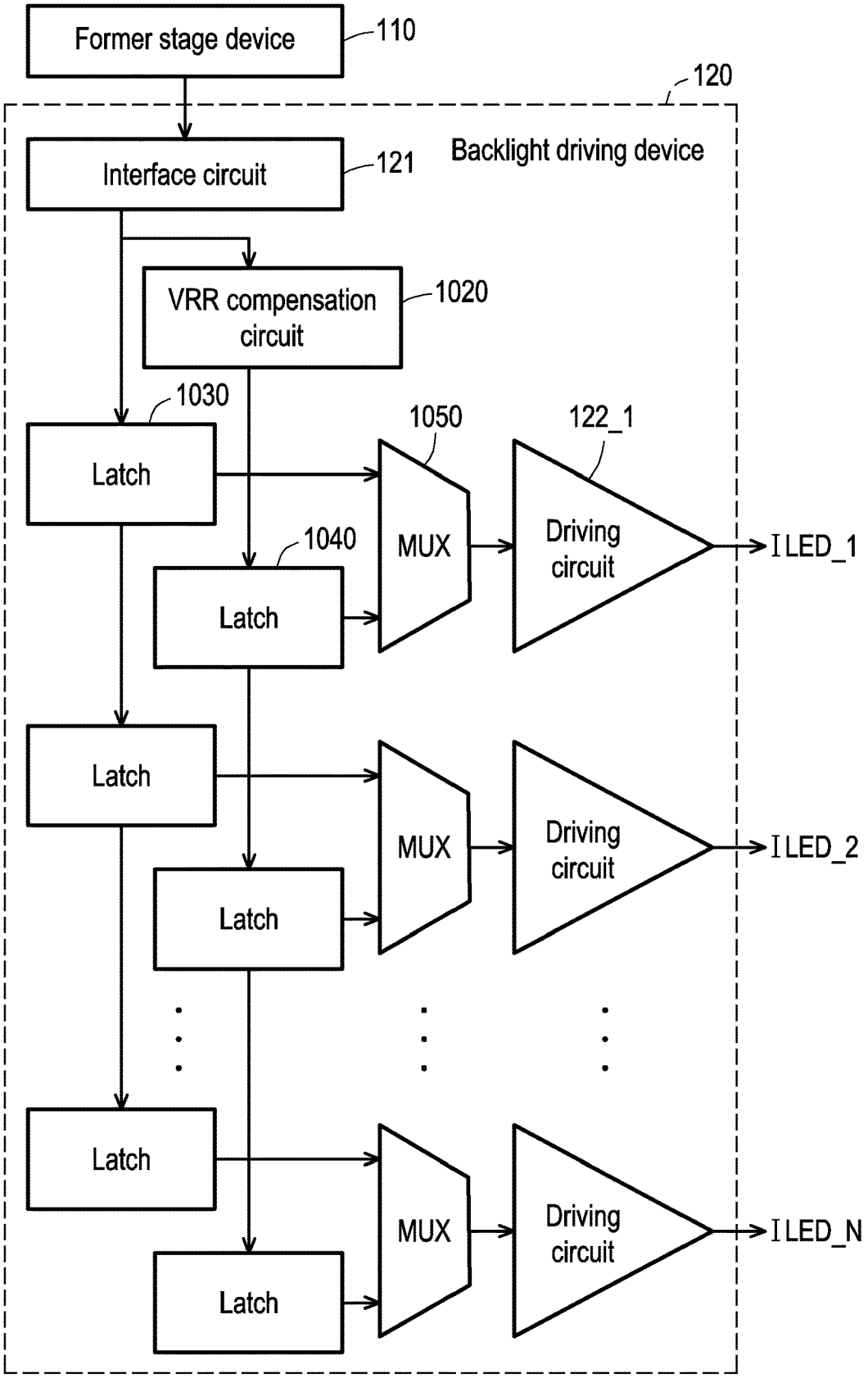
FIG. 10 is a schematic diagram of a circuit block of a backlight driving device according to an embodiment of the disclosure.

FIG. 10 is a schematic diagram of a circuit block of the backlight driving device 120 according to an embodiment of the disclosure. The backlight driving device 120 shown in FIG. 10 may output multiple driving currents ILED_1, ILED_2, . . . , ILED_N to different backlight zones of the backlight panel 130 shown in FIG. 1 based on the main backlight data provided by the former stage device 110, so as to drive the backlight zones of the backlight panel 130 to provide backlight to different display regions of the display panel 140. For example, the backlight driving device 120 may output the driving current ILED_1 to the backlight zone Z1 of the backlight panel 130, so as to drive the backlight zone Z1 to provide backlight to the corresponding display region of the display panel 140. The following content will describe an example of the generation of the driving current ILED_1. The other driving currents ILED_2 to ILED_N may be analogized with reference to the relevant description of the driving current ILED_1, so there will be no repetition.

In the embodiment shown in FIG. 10, the backlight driving device 120 further includes a variable refresh rate (VRR) compensation circuit 1020, a latch 1030, a latch 1040, and a multiplexer (MUX) 1050. For a driving circuit 122_1 shown in FIG. 10, reference may be made to the relevant description of the driving circuit 122 shown in FIG. 1. An input terminal of the latch 1030 is coupled to the interface circuit 121 to receive and store the main backlight data corresponding to the backlight zone Z1 of the backlight panel 130.

Please refer to FIG. 1, FIG. 8, and FIG. 10. An input terminal of the variable refresh rate compensation circuit 1020 is coupled to the interface circuit 121 to receive the main backlight data of the backlight zones (for example, the backlight zones Z1 to Z4 shown in FIG. 7) of the backlight panel 130. The variable refresh rate compensation circuit 1020 generates multiple backlight compensation data of the backlight zones according to the main backlight data. For example, the variable refresh rate compensation circuit 1020 may calculate D*m/(n+m) to generate the backlight compensation data corresponding to the backlight zone Z1, where D represents the main backlight data corresponding to the backlight zone Z1, m represents the length of the display refresh period of the backlight frame period Fb_A, and n represents the length of the demotion blur period of the backlight frame period Fb_A.

An input terminal of the latch 1040 is coupled to an output terminal of the variable refresh rate compensation circuit 1020 to receive and store the backlight compensation data corresponding to the backlight zone Z1 of the backlight panel 130. A first input terminal of the multiplexer 1050 is coupled to an output terminal of the latch 1030 to receive the main backlight data corresponding to the backlight zone Z1. A second input terminal of the multiplexer 1050 is coupled to an output terminal of the latch 1040 to receive the backlight compensation data corresponding to the backlight zone Z1. An output terminal of the multiplexer 1050 is coupled to an input terminal of the driving circuit 122_1. When the multiplexer 1050 transmits the main backlight data corresponding to the backlight zone Z1 to the driving circuit 122_1, the driving circuit 122_1 may determine the driving current ILED_1 to be the main current level I81 according to the main backlight data in the display refresh period. When the multiplexer 1050 transmits the backlight compensation data corresponding to the backlight zone Z1 to the driving circuit 122_1, the driving circuit 122_1 may determine the driving current ILED_1 to be the compensation current level I82 according to the backlight compensation data.

Except for the embodiment shown in FIG. 10, the determining manner of the compensation current level may be implemented according to other practical designs. For example, in other embodiments, the backlight driving device 120 may receive the main backlight data and the backlight compensation data corresponding to the backlight frame period Fb_A shown in FIG. 8 from the former stage device 110. The driving circuit 122 may determine the main current level I81 in the display refresh period of the backlight frame period Fb_A according to the main backlight data, and determine the compensation current level I82 in the vertical blanking period of the backlight frame period Fb_A according to the backlight compensation data.

Figure 11:
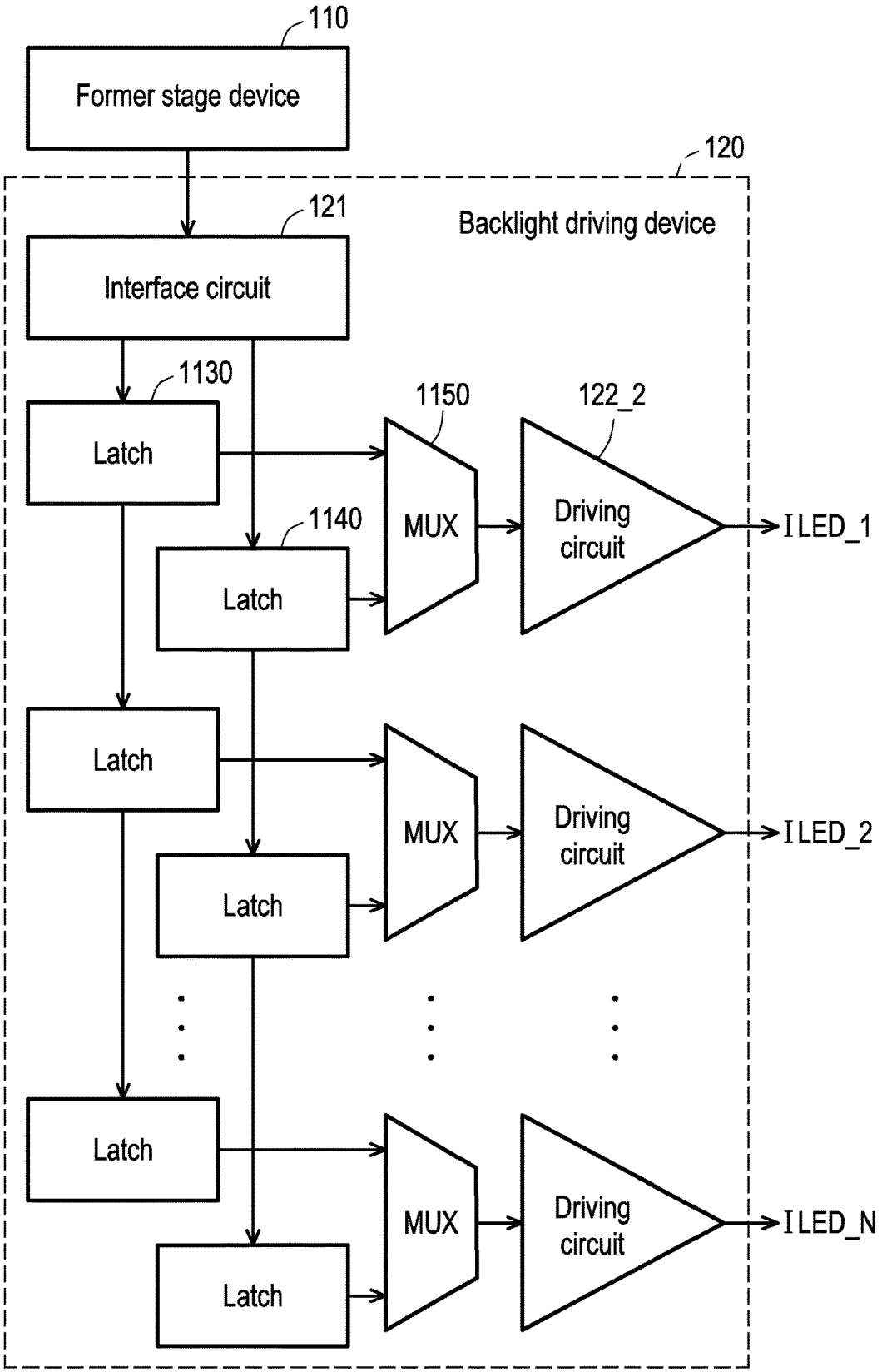
FIG. 11 is a schematic diagram of a circuit block of a backlight driving device according to another embodiment of the disclosure.

FIG. 11 is a schematic diagram of a circuit block of the backlight driving device 120 according to another embodiment of the disclosure. The backlight driving device 120 shown in FIG. 11 may output multiple driving currents ILED_1, ILED_2, . . . , ILED_N to different backlight zones of the backlight panel 130 shown in FIG. 1 based on the main backlight data provided by the former stage device 110, so as to drive the backlight zones of the backlight panel 130 to provide backlight to different display regions of the display panel 140. For the backlight driving device 120 and the driving currents ILED_1 to ILED_N shown in FIG. 11, reference may be made to the relevant descriptions of the backlight driving device 120 and the driving currents ILED_1 to ILED_N shown in FIG. 10, so there will be no repetition. The following content will describe an example of the generation of the driving current ILED_1. The other driving currents ILED_2 to ILED_N may be analogized with reference to the relevant description of the driving current ILED_1, so there will be no repetition.

The former stage device 110 may calculate multiple main backlight data of different backlight zones according to multiple pixel data of different display regions, and provide the main backlight data of the backlight zones to the backlight driving device 120. The former stage device 110 may also generate multiple backlight compensation data of different backlight zones according to the main backlight data. For example, taking the backlight frame period Fb_A shown in FIG. 8 as an example, the former stage device 110 may calculate D*m/(n+m) to generate the backlight compensation data corresponding to the backlight zone Z1, where D represents the main backlight data corresponding to the backlight zone Z1, m represents the length of the display refresh period of the backlight frame period Fb_A, and n represents the length of the demotion blur period of the backlight frame period Fb_A. The interface circuit 121 of the backlight driving device 120 may receive the main backlight data and the backlight compensation data corresponding to the backlight frame period Fb_A shown in FIG. 8 from the former stage device 110.

In the embodiment shown in FIG. 11, the backlight driving device 120 further includes a latch 1130, a latch 1140, and a multiplexer (MUX) 1150. For a driving circuit 122_2 shown in FIG. 11, reference may be made to the relevant description of the driving circuit 122 shown in FIG. 1. An input terminal of the latch 1130 is coupled to the interface circuit 121 to receive and store the main backlight data corresponding to the backlight zone Z1 of the backlight panel 130. An input terminal of the latch 1140 is coupled to the interface circuit 121 to receive and store the backlight compensation data corresponding to the backlight zone Z1 of the backlight panel 130. A first input terminal of the multiplexer 1150 is coupled to an output terminal of the latch 1130 to receive the main backlight data corresponding to the backlight zone Z1. A second input terminal of the multiplexer 1150 is coupled to an output terminal of the latch 1140 to receive the backlight compensation data corresponding to the backlight zone Z1. An output terminal of the multiplexer 1150 is coupled to an input terminal of the driving circuit 122_2. When the multiplexer 1150 transmits the main backlight data corresponding to the backlight zone Z1 to the driving circuit 122_2, the driving circuit 122_2 may determine the driving current ILED_1 to be the main current level I81 according to the main backlight data in the display refresh period. When the multiplexer 1150 transmits the backlight compensation data corresponding to the backlight zone Z1 to the driving circuit 122_2, the driving circuit 122_2 may determine the driving current ILED_1 to be the compensation current level I82 according to the backlight compensation data.

In summary, the backlight panel 130 of the foregoing embodiments has multiple backlight zones, such as the backlight zones Z1 to Z4 shown in FIG. 7. Different backlight zones correspond to different display regions of the display panel. For any backlight zone, the backlight frame period thereof corresponds to the display frame period of the display panel. Each backlight frame period includes the demotion blur period, the display refresh period, and the vertical blanking period. The driving circuit 122-2 may not drive the backlight zone in the demotion blur period, that is, the backlight zone does not provide backlight to the corresponding display region of the display panel 140 in the demotion blur period, so as to prevent the viewer from perceiving the motion blur of the display panel. In the display refresh period which succeeds the demotion blur period, the driving circuit 122-2 drives the backlight zone of the backlight panel 130 with the main current level (for example, the main current level I81 shown in FIG. 8) corresponding to the main backlight data, so as to provide brighter backlight to the corresponding display region of the display panel. In the vertical blanking period which succeeds the display refresh period, the driving circuit 122-2 drives the backlight zone of the backlight panel 130 with the compensation current level (for example, the compensation current level I82 shown in FIG. 8, that is, the original driving current level calculated based on the dimming algorithm) lower than the main current level, so as to provide the original backlight brightness calculated based on the dimming algorithm to the corresponding display region of the display panel 140. Therefore, the dimming of the backlight zone may be adapted to the variable refresh rate (VRR) mode of the display panel 140.

Although the disclosure has been disclosed in the above embodiments, the embodiments are not intended to limit the disclosure. Persons skilled in the art may make some changes and modifications without departing from the spirit and scope of the disclosure. Therefore, the protection scope of the disclosure shall be defined by the appended claims.

What is claimed is:

1. A backlight driving device for driving a plurality of backlight zones of a backlight panel, comprising:

an interface circuit, adapted for receiving first main backlight data corresponding to a first backlight zone among the backlight zones from a former stage device; and a driving circuit, adapted for driving the first backlight zone among the backlight zones according to a first main current level in a display refresh period of a first backlight frame period with respect to the first backlight zone, not driving the first backlight zone in a demotion blur period of the first backlight frame period which is prior to the display refresh period, and driving the first backlight zone according to a first compensation current level in a vertical blanking period of the first backlight frame period which succeeds the display refresh period of the first backlight frame period, wherein the driving circuit determines the first main current level according to the first main backlight data, and the first compensation current level is lower than the first main current level.

2. The backlight driving device according to claim 1, wherein the driving circuit determines the first compensation current level according to first backlight compensation data, the driving circuit obtains the first backlight compensation data according to the first main backlight data and a ratio, and the ratio is determined based on a length of the display refresh period of the first backlight frame period and a length of the demotion blur period of the first backlight frame period.

3. The backlight driving device according to claim 1, further comprising:

a variable refresh rate compensation circuit, having an input terminal coupled to the interface circuit to receive the first main backlight data, wherein the variable refresh rate compensation circuit generates first backlight compensation data according to the first main backlight data;

a first latch, having an input terminal coupled to the interface circuit to receive and store the first main backlight data;

a second latch, having an input terminal coupled to an output terminal of the variable refresh rate compensation circuit to receive and store the first backlight compensation data; and a multiplexer, having a first input terminal coupled to an output terminal of the first latch, wherein a second input terminal of the multiplexer is coupled to an output terminal of the second latch, an output terminal of the multiplexer is coupled to an input terminal of the driving circuit, and the driving circuit further determines the first compensation current level according to the first backlight compensation data.

4. The backlight driving device according to claim 3, wherein the variable refresh rate compensation circuit calculates D*m/(n+m) to generate the first backlight compensation data, where D represents the first main backlight data, m represents a length of the display refresh period, and n represents a length of the demotion blur period.

5. The backlight driving device according to claim 1, wherein:

the driving circuit is adapted for driving a second backlight zone among the backlight zones according to a second main current level in a display refresh period of a second backlight frame period with respect to the second backlight zone, not driving the second backlight zone in a demotion blur period of the second backlight frame period which is prior to the display refresh period of the second backlight frame period, and driving the second backlight zone according to a second compensation current level in a vertical blanking period of the second backlight frame period which succeeds the display refresh period of the second backlight frame period, wherein the driving circuit determines the second main current level according to second main backlight data, and the second compensation current level is lower than the second main current level; and the second backlight frame period starts after the first backlight frame period starts, the second backlight zone is used as a backlight source of a second display region, and the second display region refreshes display data after a first display region refreshes display data, wherein the first display region uses the first backlight zone as a backlight source.

6. The backlight driving device according to claim 1, wherein the interface circuit further receives first backlight compensation data corresponding to the first backlight frame period from the former stage device, and the driving circuit determines the first compensation current level according to the first backlight compensation data.

7. The backlight driving device according to claim 6, further comprising:

a first latch, having an input terminal coupled to the interface circuit to receive and store the first main backlight data;

a second latch, having an input terminal coupled to the interface circuit to receive and store the first backlight compensation data; and a multiplexer, having a first input terminal coupled to an output terminal of the first latch, wherein a second input terminal of the multiplexer is coupled to an output terminal of the second latch, and an output terminal of the multiplexer is coupled to an input terminal of the driving circuit.

8. An operating method of a backlight driving device for driving a plurality of backlight zones of a backlight panel, the operating method comprising:

receiving, by an interface circuit of the backlight driving device, first main backlight data corresponding to a first backlight zone among the backlight zones from a former stage device;

driving, by a driving circuit of the backlight driving device, a first backlight zone among the backlight zones according to a first main current level in a display refresh period of a first backlight frame period with respect to the first backlight zone;

not driving, by the driving circuit, the first backlight zone in a demotion blur period of the first backlight frame period which is prior to the display refresh period; and driving, by the driving circuit, the first backlight zone according to a first compensation current level in a vertical blanking period of the first backlight frame period which succeeds the display refresh period of the first backlight frame period, wherein the driving circuit determines the first main current level according to the first main backlight data, and the first compensation current level is lower than the first main current level.

9. The operating method according to claim 8, further comprising:

obtaining, by the driving circuit, first backlight compensation data according to the first main backlight data and a ratio, wherein the ratio is determined based on a length of the display refresh period of the first backlight frame period and a length of the demotion blur period of the first backlight frame period; and determining, by the driving circuit, the first compensation current level according to the first backlight compensation data.

10. The operating method according to claim 8, further comprising:

generating, by a variable refresh rate compensation circuit of the backlight driving device, first backlight compensation data according to the first main backlight data; and determining, by the driving circuit, the first compensation current level according to the first backlight compensation data.

11. The operating method according to claim 10, further comprising:

calculating, by the variable refresh rate compensation circuit, D*m/(n+m) to generate the first backlight compensation data, where D represents the first main backlight data, m represents a length of the display refresh period, and n represents a length of the demotion blur period.

12. The operating method according to claim 8, further comprising:

driving, by the driving circuit, a second backlight zone among the backlight zones according to a second main current level in a display refresh period of a second backlight frame period with respect to the second backlight zone;

not driving, by the driving circuit, the second backlight zone in a demotion blur period of the second backlight frame period which is prior to the display refresh period of the second backlight frame period; and driving, by the driving circuit, the second backlight zone according to a second compensation current level in a vertical blanking period of the second backlight frame period which succeeds the display refresh period of the second backlight frame period, wherein the driving circuit determines the second main current level according to second main backlight data, the second compensation current level is lower than the second main current level, the second backlight frame period starts after the first backlight frame period starts, the second backlight zone is used as a backlight source of a second display region, the second display region refreshes display data after a first display region refreshes display data, and the first display region uses the first backlight zone as a backlight source.

13. The operating method according to claim 8, further comprising:

receiving, by the interface circuit, first backlight compensation data corresponding to the first backlight frame period from the former stage device; and determining, by the driving circuit, the first compensation current level according to the first backlight compensation data.

* * * * *